United States Patent [19]

Yamagishi et al.

[11] Patent Number: 5,048,092

[45] Date of Patent: Sep. 10, 1991

[54] ELECTROACOUSTIC TRANSDUCER APPARATUS

[75] Inventors: Makoto Yamagishi, Tokyo; Satoshi Matui, Kanagawa, both of Japan

[73] Assignee: Sony Corporation, Tokyo, Japan

[21] Appl. No.: 445,429

[22] Filed: Dec. 4, 1989

[30] Foreign Application Priority Data

Dec. 12, 1988 [JP] Japan ..... 63-161025[U]

[51] Int. Cl.[5] ..... H04R 25/00

[52] U.S. Cl. ..... 381/187; 381/68.6; 381/69; 181/135

[58] Field of Search ..... 381/187, 68.6, 68, 69; 181/130, 135

[56] References Cited

U.S. PATENT DOCUMENTS

| | | | |
|---|---|---|---|
| 3,470,328 | 9/1969 | Daniels | 381/68.6 |
| 3,702,123 | 11/1972 | Macken et al. | 181/135 |
| 4,442,917 | 4/1984 | Johnson | 181/135 |
| 4,532,649 | 7/1985 | Bellafiore | 381/68.6 |
| 4,617,429 | 10/1986 | Bellafiore | 381/69 |
| 4,646,872 | 5/1987 | Kamon et al. | 381/187 |
| 4,729,451 | 3/1988 | Brander et al. | 381/69 |
| 4,742,887 | 5/1988 | Yamagishi | 381/187 |

*Primary Examiner*—Forester W. Isen
*Assistant Examiner*—M. N. McGeary, III
*Attorney, Agent, or Firm*—Philip M. Shaw, Jr.

[57] ABSTRACT

An electroacoustic transducer apparatus of a type that it is inserted into a cavum concha upon use. The electroacoustic transducer apparatus of the invention is applied to a headphone of a so-called in-the-eart type or so-called inner-ear type. This headphone is provided with an air passage portion formed through an elastic ring member attached to the outer peripheral portion of the housing so as to communicate the inside and outside portions of a concave portion of the cavum concha upon use. Accordingly, a certain amount of sound escapes to the outside, thereby obtaining the acoustic characteristics of substantially the same level from a low band to a high band regardless of the size of the user's ears.

3 Claims, 5 Drawing Sheets

ELECTROACOUSTIC TRANSDUCER APPARATUS

BACKGROUND OF THE INVENTION

1. Field of the Invention

The present invention relates generally to electroacoustic transducers and, more particularly, is directed to an electroacoustic transducer such as an in-the-ear type headphone or the like which is worn over or inserted into a cavum concha (a concaved portion of an auricle of the ear).

2. Description of the Prior Art

A so-called in-the-ear type headphone is known, and is inserted into an auricle upon use. FIG. 1 shows an example of such in-the-ear type headphone.

Referring to FIG. 1, it will be seen that a driver unit 15 is accommodated within a housing 16. The driver unit 15 is an electroacoustic transducer element and is formed of a diaphragm, a magnetic circuit and the like, though not shown. An external connection cord 17 is extended from the driver unit 15 and is supported by a cord supporting member 18 which is elongated from the housing 16.

As shown in FIG. 2, the housing 16 has a proper size so that it can be inserted into a cavum concha b which is a concaved portion of an auricle a. Thus, when the housing 16 is inserted into the cavum concha b, the housing 16 is supported at at least two outer points thereof by a tragus c and an antitragus d which form a part of the auricle a.

The rear peripheral portion of the housing 16 is tapered as an inclined portion 19 so that, when the housing 16 is inserted into the cavum concha b, it is opposed to the outside of the auricle a. The inclination angle of the inclined portion 19 is selected so that the inclined portion 19 substantially corresponds to the curved, rising surface of the cavum concha b.

The cord supporting member 18 elongated from the housing 16 is downwardly elongated from the lower end of a rear side end face portion 20 of the housing 16 in substantially parallel to the rear side end face portion 20 so that, when the housing 16 is inserted into the cavum concha b, the cord supporting member 18 comes in contact with a point P3 on the outer surface of a lobe e at a position lower than points PI and P2 of the top portions of the tragus c and the antitragus d. The points Pl and P2 are the supporting points to support the housing 16.

A ring member 21 is made of a flexible and elastic material and is engaged with a bonding portion in which the driver unit 15 and the housing 16 are bonded to each other. A front surface of the diaphragm (not shown) of the driver unit 15 is protected by a protecting plate 22 a shown in FIG. 1.

According to the headphone thus arranged, as shown in FIG. 2, the housing 16 thereof is inserted into the cavum concha b by a three-point-supporting fashion so that it can be held at one portion of the auricle a without pressing the auditory opening.

In order that any user may wear the headphone of the example of FIG. 1 in a properly-fitted state regardless of different sizes of the ears, the elastic ring member 21 is engaged with the outer peripheral portion of the housing 16 so that the headphone can be easily fitted to the cavum concha b thereby to increase a closed property of the headphone.

Although the low band can be suppressd, i.e. bass can be produced by increasing the closed property when the in-the-ear type headphone is used, there are large differences in ear sizes and shapes, thus making it impossible to form the elastic ring member so that it can be properly fitted to any ears regardless of the size and shape of the ear. For example, if the ring member is formed so as to be fitted to a relatively small ear, a frequency characteristic shown by a solid line S in FIG. 3A can be brought about for small ears. However, the low band is lowered for large ears as shown by a dashed line L in FIG. 3A and no bass is produced. If on the other hand the ring member is formed so as to be fitted to large ears, a frequency characteristic shown by a solid line L in FIG. 3B can be brought about for large ears and the low band is increased too much as shown by a dashed line S in FIG. 3B for small ears. Thus, the too much bass is produced too much and good acoustic characteristics can not be obtained for the small ears.

OBJECTS AND SUMMARY OF THE INVENTION

Accordingly, it is an object of the present invention to provide an improved electroacoustic transducer apparatus which can eliminate the defects encountered with the prior art.

More specifically, it is an object of the present invention to provide an electroacoustic transducer apparatus which can provide acoustic characteristics of substantially the same level from a low band to a high band regardless of the size of the user's ear.

It is another object of the present invention to provide an electroacoustic transducer apparatus which is suitably applied to a so-called in-the-ear type or so-called inner-ear type headphone According to an aspect of the present invention, there is provided an electroacoustic transducer apparatus comprising:

(a) a housing formed so as to be accommodated within a concave portion of a cavum concha between tragus and antitragus of an auricle, said housing having a front side and a rear side and being supported by said tragus and antitragus when accommodated within said concave portion of said auricle;

(b) an electroacoustic transducer element incorporated within said housing; and (c) an elastic ring member attached to an outer peripheral portion of said housing, wherein an air passage portion is formed through equalize the pressure on both the front side and rear side of the housing said ring member so as to The above, and other objects, features and advantages of the present invention, will be apparent in the following detailed description of preferred embodiments when read in conjunction with the accompanying drawings, in which like reference numerals are used to identify the same or similar parts in the several views.

DETAILED DESCRIPTION OF PREFERRED EMBODIMENTS

Figure 2:
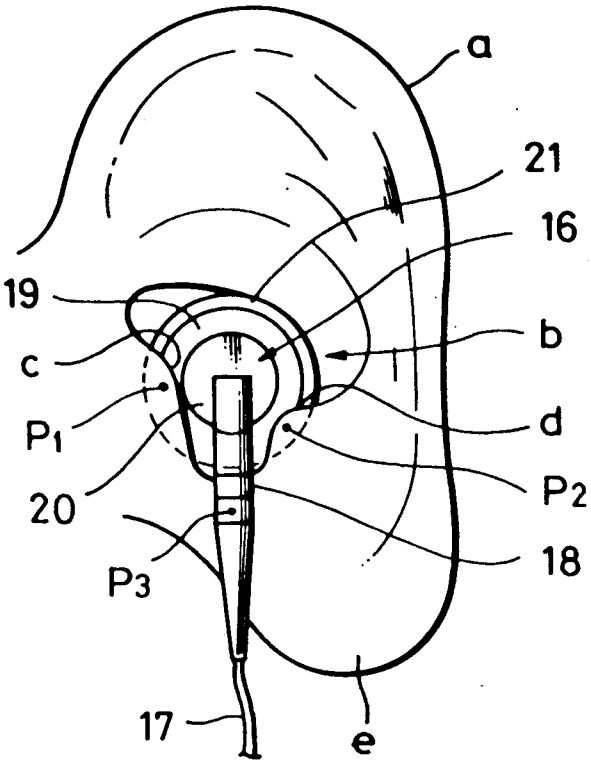
FIG. 2 (PRIOR ART)
FIG. 2 is a pictorial representation of the headphone of FIG. 1, and illustrating the condition that the headphone is worn in use.
Figure 1:
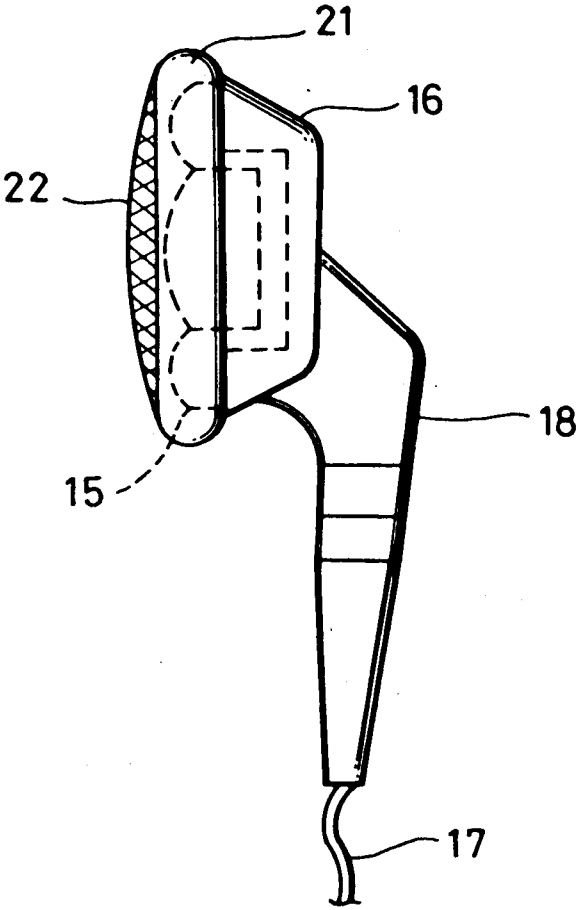
FIG. 1 (PRIOR ART)
FIG. 1 is a side view illustrating an example of a prior-art headphone of a so-called in-the-ear type.
Figure 4:
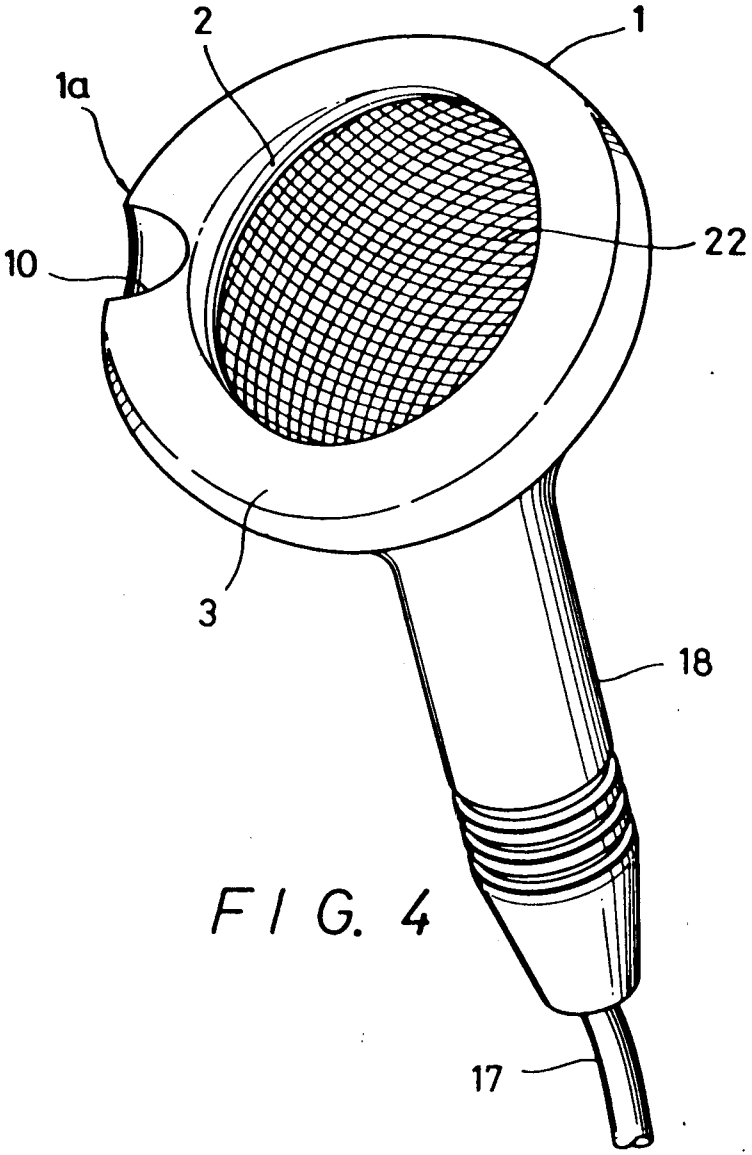
FIG. 4 is a perspective view illustrating an electroacoustic transducer apparatus according to a first embodiment of the present invention.
Figure 3A:
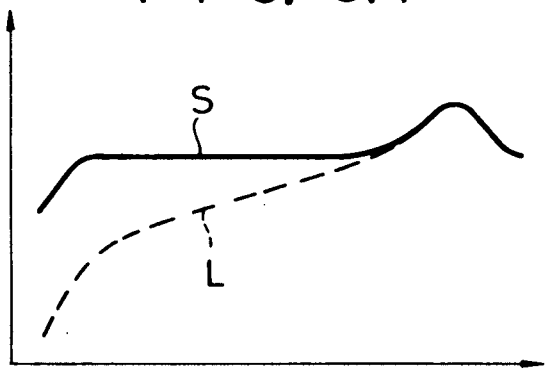
FIGS. 3A and 3B are diagrams of frequency characteristics of the headphone of FIG. 1, and to which reference will be made in explaining the acoustic characteristics of the prior-art headphone.
Figure 3B:
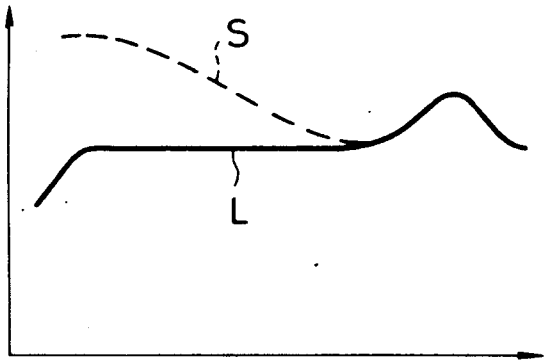
Figure 5:
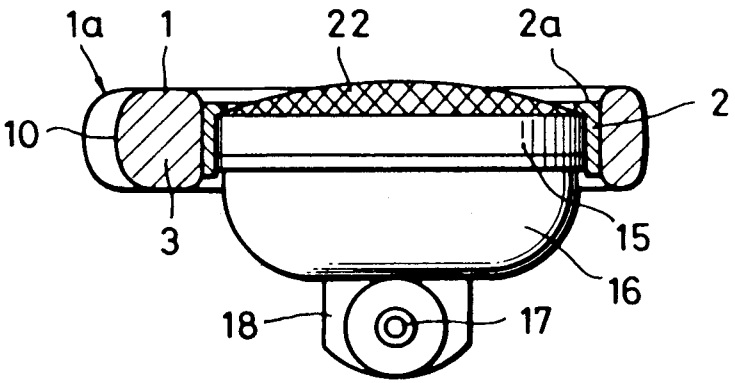
FIG. 5 is a partially cut-away bottom view of the electroacoustic transducer apparatus of FIG. 4.

An electroacoustic transducer apparatus according to a first embodiment of the present invention will hereinafter be described with reference to FIGS. 4 and 5. In FIGS. 4 and 5, like parts corresponding to those of FIG. 1 are marked with the same references and therefore need not be described in detail.

Figure 6:
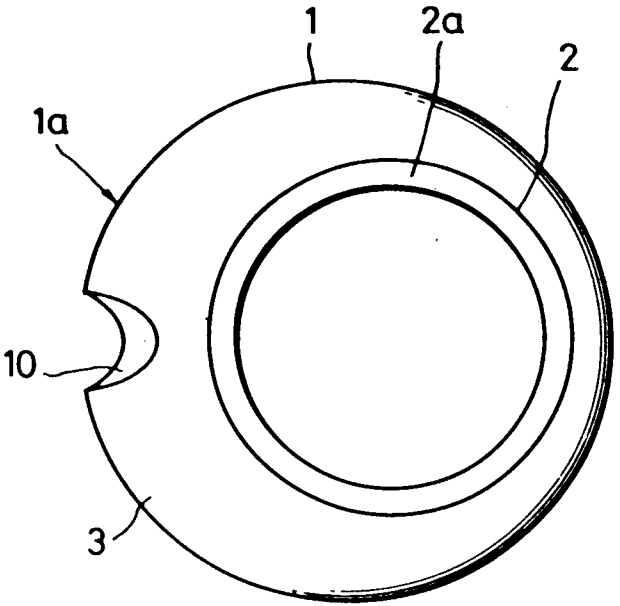
FIG. 6 is a front view of a ring member used in the electroacoustic transducer apparatus of FIG. 4.
Figure 7:
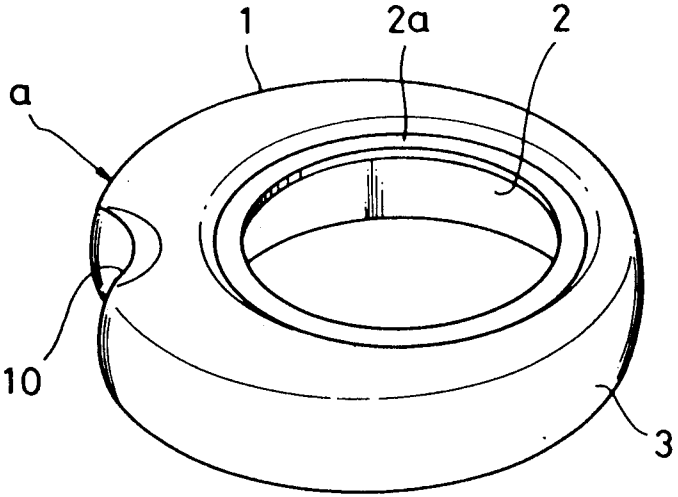
FIG. 7 is a perspective view of FIG. 6.

Referring to FIGS. 4 and 5, it will be seen that the elastic ring member 1 is secured to a bonding portion in which the housing 16 and the driver unit 15 are bonded. As shown in FIGS. 6 and 7, the ring member 1 is formed such that central positions of inner and outer circles are displaced from each other, or that the ring member 1 protrudes at the center thereof to one direction to provide a thick portion 1*a*. In the ring member 1, an inside base ring portion 2 and an outside elastic ring portion 3 are molded by, for example, a so-called dichromatic molding method (i.e. double-molding method).

The inside ring portion 2 is formed by molding a resin having a sufficient hardness, for example, acrylonitrile butadiene styrene copolymer (ABS) resin, and this base ring portion 2 is formed as a cylindrical-shaped portion having a flange portion 2*a* inwardly formed on one edge portion thereof. The elastic ring portion 3 is formed by molding an elastic material, for example, a urethan resin. The ring portion 3 is formed with a displacement relative to the base ring portion 2 in order to form the thick portion 1*a*, and a concave groove portion 10 is formed in the thick portion 1*a* at the outer surface portion of the portion 1*a* and in the axis direction of the ring member 1.

The above-mentioned ring member 1 is secured to the bonding portion between the housing 16 and the driver unit 15 in such a fashion that the flange portion 2*a* of the base ring portion 2 is located in the protecting plate 22 side. In this case, the flange portion 2*a* is engaged with the protecting plate 22. The ring member 1 is so arranged that its thick portion 1*a* is opposed to the antitragus d side. FIGS. 4 and 5 illustrate the headphone which is fitted to the left ear. Though not shown, if the headphone is formed so as to be fitted to the right ear, a thick portion is protruded in the opposite direction.

Figure 8:
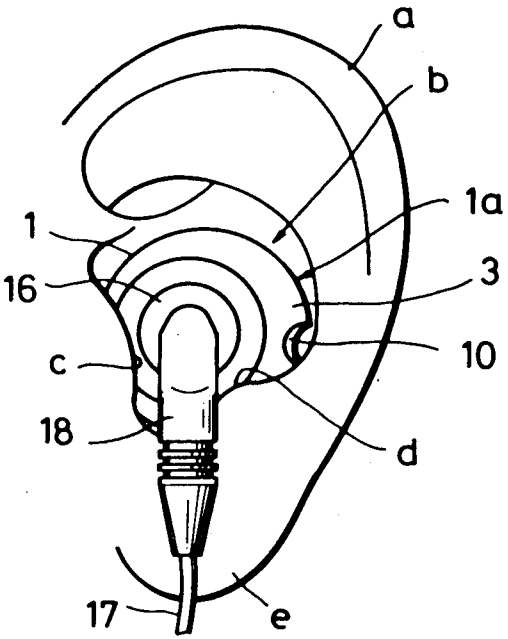
FIG. 8 is a pictorial representation of the electroacoustic transducer apparatus of FIG. 4, and illustrating the condition that it is worn in use.

Upon use, the headphone constructed according to the first embodiment of the present invention is inserted into the cavum concha b as shown in FIG. 8.

Figure 9:
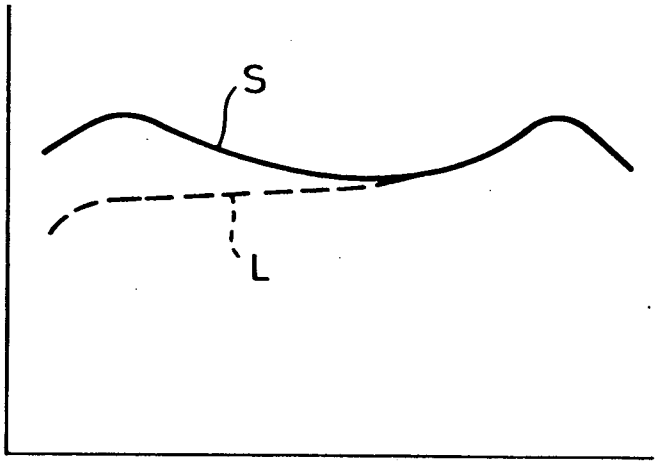
FIG. 9 is a diagram of a frequency characteristic of the electroacoustic transducer apparatus of FIG. 4, and to which reference will be made in explaining the operation of the present invention.

The entrance of the external auditory miatus is not located at the center of the cavum concha b and is located in the side of tragus c. According to the first embodiment of the present invention, the elastic ring member 1 is formed to have the thick portion 1*a* protruded toward the antitragus d so that, when the user wears this type of headphone, this headphone can be properly fitted to the user's ear, thereby increasing a closed property. In this case, the concaved groove portion 10 is formed in the thick portion 1*a* of the ring member 1, thereby forming an air passage portion in the direction parallel to the axis of the ring member 1. Thus, the inside and outside portions of the cavum concha b are communicated with each other by a certain amount of air passing through the concaved groove portion 10. Therefore, a certain amount of sound escapes to the outside through the above-mentioned air passage portion, whereby the difference of a closed property, caused by the size and shape of ears, can be reduced. Accordingly, the difference between the frequency characteristic S provided by a small ear and the frequency characteristic L provided by a large ear can be reduced as shown in FIG. 9, which fact makes it clear that almost all users can gain excellent acoustic characteristics by using the headphone of the first embodiment.

Figure 10:
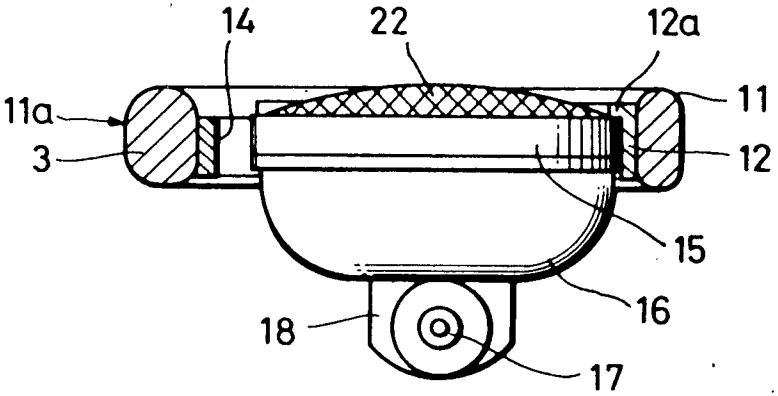
FIG. 10 is a partially cut-away bottom view of an electroacoustic transducer apparatus according to a second embodiment of the present invention.

An electroacoustic transducer apparatus according to a second embodiment of the present invention will be explained with reference to FIGS. 10 and 11. In FIG. 10, like parts corresponding to those of FIG. 1 are marked with the same references and therefore need not be described in detail.

In the second embodiment of the present invention, the ring member 1 secured to the bonding portion between the housing 16 and the driver unit 15 is constructed as follows.

Figure 11:
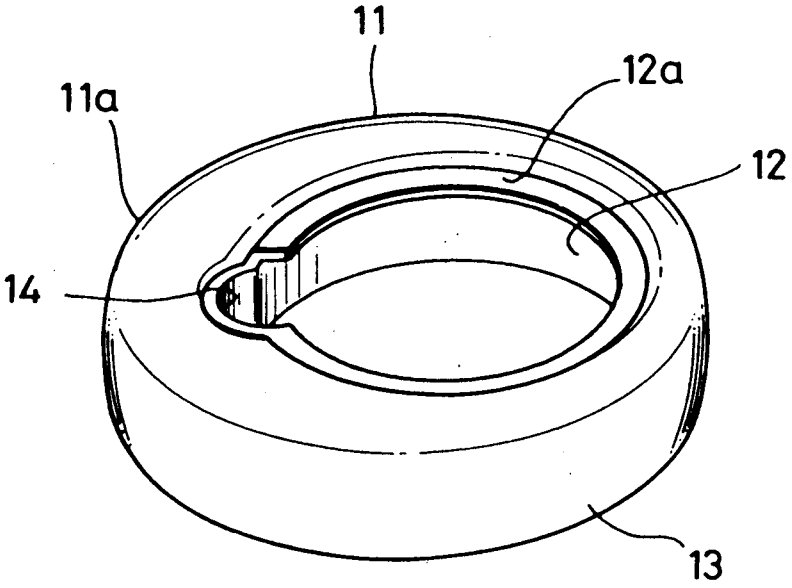
FIG. 11 is a perspective view illustrating a ring member used in the second embodiment of the present invention.

Referring initially to FIG. 11, it will be seen that the ring member 11 has a similar outer configuration to that of the ring member 1 of the first embodiment in which the center positions of the inner circle and outer circle are displaced from each other, or that a thick portion 11*a* is protruded from the center to one direction. In this embodiment, however, the shape of the inner peripheral portion of the ring member 11 is different from that of the afore-noted ring member 1. This will be explained more fully below.

This ring member 11 is comprised of a cylindrical base ring portion 12 having a flange portion 12*a* inwardly formed around one edge portion thereof and an eccentric elastic ring portion 13 formed around the outer peripheral portion of the base ring portion 12. A one portion of the peripheral surface of the base ring portion 12, i.e. one portion of the base ring portion 12 corresponding to the same direction of the thick portion 11*a* of the ring member 11 is curved to the outer peripheral side thereof to form a concave groove portion 14 extended in the axial direction of the ring member 11.

Similar to the ring member 1 of the first embodiment of the present invention, this ring member 11 is formed by the dichromatic molding-process. For example, its base ring portion 12 is formed by the molding-process of acrylonitrile butadiene styrene copolymer (ABS) resin or the like, and the elastic ring portion 13 is formed by the molding-process of, for example, urethane resin or the like.

As shown in FIG. 10, the thus constructed ring member 11 is secured to the bonding portion between the housing 16 and the driver unit 15 such that the flange portion 12*a* of the base ring portion 12 is located at the protecting plate 22 side of the driver unit 15. Accordingly, an air passage portion is formed between the inner peripheral portion of the base ring portion 12 and the peripheral surface of the housing 16 by the concave groove portion 14 of the base ring portion 12 in its axial direction.

The electroacoustic transducer apparatus shown in FIGS. 10 and 11 is applied to the headphone for the left ear as described above. If the present invention is applied to a headphone for the right ear, then the thick portion 11*a* will increase its thickness in the opposite direction.

Upon use, the thus constructed headphone of this embodiment is inserted into the cavum concha b similarly to the headphone of the first embodiment of FIG. 8. According to the second embodiment of the present invention, the elastic ring member 11 is formed so as to protrude to the side of antitragus d so that, when the user wears this type of headphone, the headphone of the present invention can be properly fitted to the user's ear with ease, thereby increasing the closed property. Simultaneously, the air passage portion is formed between the ring member 11 and the housing 16 by the concave groove portion 14, thereby connecting the inside and outside portions of the cavum concha b with a certain amount of air. Thus, similar action and effect to those of the first embodiment can be achieved.

Figure 12:
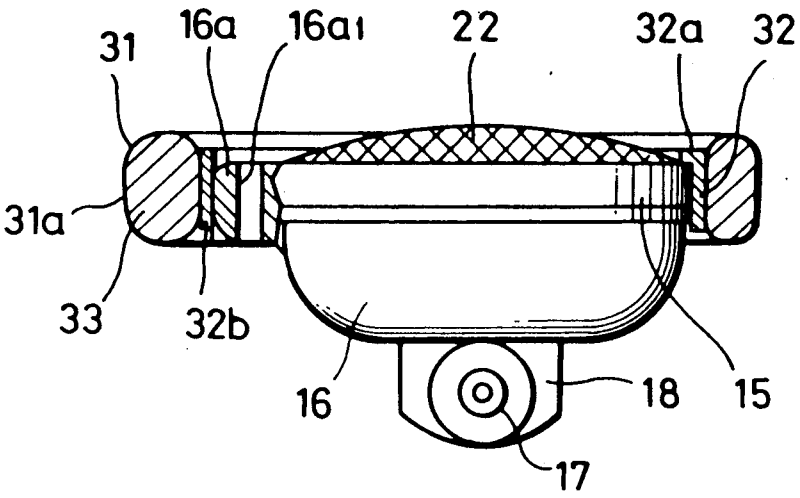
FIG. 12 is a partially cut-away bottom view of an electroacoustic transducer apparatus according to a third embodiment of the present invention.

FIG. 12 illustrates an electroacoustic transducer apparatus according to a third embodiment of the present invention. In FIG. 12, like parts corresponding to those of FIG. 1 are marked with the same references and therefore need not be described in detail.

In accordance with the third embodiment of the present invention, as shown in FIG. 12, the housing 16 has a thick portion 16*a* formed at one portion of the outer periphery thereof, and an air hole $16_{al}$ is formed through the thick portion 16*a* in the front to rear direction thereof. The housing 16 is attached with a ring member 31 formed similarly to the ring member 1 of the first embodiment.

As shown in FIG. 12, the ring member 31 has a thick portion 31*a* which is protruded from the center of the ring member 31 to one direction. A cylindrical base ring portion 32 has a flange portion 32*a* inwardly formed around one edge portion thereof and a thick portion 32*b* formed at one portion thereof. The configuration of the thick portion 32*b* follows the configuration of the outer peripheral portion of the housing 16, i.e. the outer peripheral portion having the thick portion 16*a*. The thick portion 32*b* is opposed to the thick portion 16*a* of the housing 16 and the thick portion 31*a* of the cylindrical base ring member 31 in the same direction. An elastic ring member 33 is provided around the outer periphery of the base ring portion 32.

In the headphone constructed according to the third embodiment of the present invention, the elastic ring member 31 is formed so as to protrude toward the side of antitragus d so that, when this headphone is worn by the user, it can be properly fitted to the ear with ease, thereby increasing a closed property. Simultaneously, the inside and outside portions of the cavum concha b are communicated with each other by means of the air hole $16_{al}$ formed through the thick portion 16*a* of the housing 16 with a certain amount of air, thus achieving the same action and effect as those of the first and second embodiments of the present invention.

While in the above-mentioned first, second and third embodiments the center positions of the inner and outer circles of each of the ring members 1, 11 and 31 are displaced from each other, the outer configuration of the ring members is not limited to the circle and may be an ellipse and others so long as they increase the thickness of one portion thereof in one direction.

According to the present invention, the configuration of the apparatus is not limited to those modified examples mentioned above, and may be other one such as a true circle and so on so long as the front and rear portions of the driver unit are communicated with each other with a certain amount of air.

As set out above, according to the present invention, the air passage portion is formed through at least one of the housing incorporating therein the electroacoustic transducer element and the elastic ring member attached to the outer peripheral portion of the housing so as to communicate the outer and inner sides of the driver unit so that, when the user wears the electroacoustic transducer apparatus of the present invention, the inside and outside portions of the cavum concha are communicated with each other with a certain amount of air. Therefore, the difference of closed properties caused by the size and shape of ears can be reduced, and difference among individuals in frequency characteristic can be reduced upon use. Thus, it is possible to obtain substantially the same acoustic characteristic.

Having described preferred embodiments of the invention in detail with reference to the accompanying drawings, it is to be understood that the invention is not limited to those precise embodiments and that many changes and modifications could be effected by one skilled in the art without departing from the spirit and scope of the invention as defined in the appended claims.

We claim as our invention:

1. An electroacoustic transducer apparatus comprising:

(a) a housing formed so as to be accommodated within a concave portion of a cavum concha between tragus and antitragus of an auricle, the housing having a front side and a rear side and being supported by the tragus and anntitragus when accommodated within the concave portion of the auricle;

(b) an electroacoustic transducer element incorporated within the housing; and (c) an elastic ring member attached to an outer peripheral portion of the housing, wherein an air passage portion is formed through the ring member so as to equalize the pressure on both the front side and rear side of the housing, wherein the ring member increases in its annular width in one direction so that the center position of its inner periphery and the center position of its outer periphery are displaced from each other.

2. An electroacoustic transducer apparatus according to claim 1, wherein the air passage portion is formed through the increased annular width portion of the ring member.

3. An electroacoustic transducer apparatus according to claim 1, wherein the increased annular width portion of the ring member is secured to the housing so that, upon use, the increased annular width portion is supported by the antitragus of the auricle.

* * * * *